United States Patent [19]

Aarons

[11] 4,047,353

[45] Sept. 13, 1977

[54] RIDGE CAP HOLDING CLIPS

[75] Inventor: Raymond Joseph Aarons, Jindallee, Australia

[73] Assignee: Monier Colourtile Pty. Ltd., Darra, Australia

[21] Appl. No.: 686,553

[22] Filed: May 14, 1976

[51] Int. Cl.[2] ..... E04B 7/02; E04B 7/06

[52] U.S. Cl. ..... 52/713; 52/278; 52/463; 248/228; 403/107

[58] Field of Search ..... 52/376–278, 52/520, 478, 544, 547, 463, 484; 403/107; 248/59, 72, 228, 223.4

[56] References Cited

U.S. PATENT DOCUMENTS

| | | | |
|---|---|---|---|
| 1,576,307 | 3/1926 | Casey | 248/59 |
| 2,183,844 | 12/1939 | Murphy | 52/277 |
| 2,910,155 | 10/1959 | Dradner | 52/520 X |
| 3,047,111 | 7/1962 | Clements et al. | 52/278 X |
| 3,360,896 | 1/1968 | Wright | 52/489 |

*Primary Examiner*—Alfred C. Perham

*Attorney, Agent, or Firm*—Haseltine, Lake & Waters

[57] ABSTRACT

A clip secure a roofing ridge- or hip-cap to a building structure. The lower part of the clip is anchored to the building structure and the upper part passes between adjacent cap pieces, forming the continuous roof capping, and overlies the upper surfaces of both cap pieces. The clip is adjustable to suit the requirements of individual applications.

9 Claims, 5 Drawing Figures

RIDGE CAP HOLDING CLIPS

BACKGROUND OF THE INVENTION

This invention relates to clips for holding a roofing ridge cap. Concrete or Terra Cotta ridge caps are provided in short sections which fit together in an overlap or butt manner to form a continuous capping.

Sucn ridge caps are traditionally fixed by a concrete mortar bedded onto the tiles below along the ridge and hip line of tiled roofs. Since concrete mortar is not flexible when inevitable shrinkage or settling of the structure occurs, the mortar bond with the capping or the tiles breaks, leaving the capping unaffixed with a weak attachment to the roof. In normal to high winds the capping tends to blow off.

SUMMARY OF THE INVENTION

It is an object of this invention to avoid the above difficulty, and to provide a secure roof-cap anchorage by means of clips in addition to or in place of the bedding mortar. It is a further object to enable ridge-capping to be attached quickly and with a minimum of labour.

It is a further object of this invention to provide a secure means of holding the ridge capping in position at the stage when the mortar bedding is either eliminated or substituted by means of an alternative material.

Accordingly, the invention comprises a clip for securing a ridge- or hip-cap of the type having cap pieces mounted end-to-end to form a continuous capping, said clip including:

an upright lower part having anchoring means to attach it to the building structure;

an upper part including a depending section to pass between adjacent cap pieces and surmounted by a top section to overlie the top surfaces of both said cap pieces; and an attachment between said upright lower part and said depending section.

Preferably, the adjustment means is made adjustable vertically.

The lower part is common to clips used with either overlap or butted cap-pieces, but the upper part is differently shaped to suit each system, as will be explained below.

SHORT DESCRIPTION OF THE DRAWINGS

In order that the invention may be better understood, particular embodiments of the invention will be described by way of example with reference to the accompanying drawings, in which.

DETAILED DESCRIPTION OF THE PREFERRED EMBODIMENT OF THE INVENTION

Figure 1:
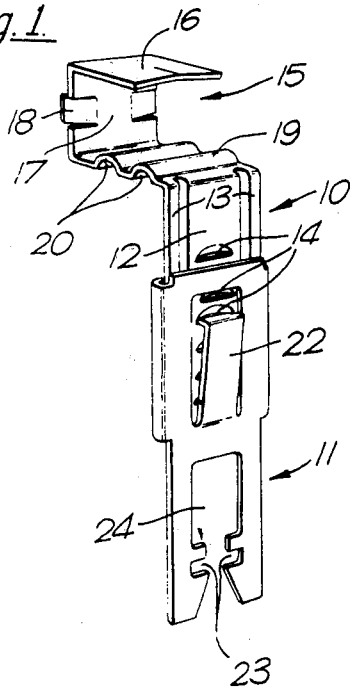
FIG. 1 is a perspective view of a clip for overlap cap-pieces.
Figure 3:
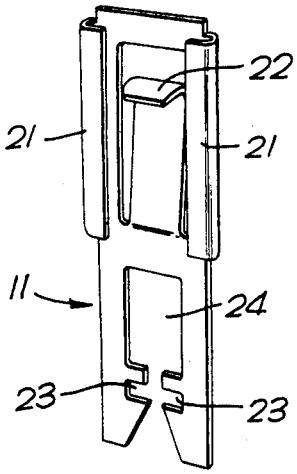
FIG. 3 is a separate perspective view of the lower part of the clip of FIG. 1 or FIG. 2.

Referring first to FIGS. 1 and 3, the clip comprises an upper part 10 and a lower part 11 (shown separately in FIG. 3).

The upper part 10 includes a depending section 12 provided with ribbed edges 13 and a series of central ratchet-type louvres 14.

The top section 15 of part 10 is of generally rectangular C-shape in section. The top horizontal flange 16 is slightly curved as shown to fit the outside of a cap section. The vertical web 17 has lugs 18 which may key into mortar used between cap section edges. The horizontal web 19 is inversely grooved at 20.

Lower part 11 has rolled edges 21 forming guides for the edges 13 of part 10, and has a ratchet tongue 22 struck out from it to engage louvres 14 of part 10. The lower end of part 11 is formed for attachment to the structure of a building, typically to the ridge-board of a building. As shown, part 11 is provided with facing notches 23 below opposed lugs in a slot or cutout 24, which notches may be engaged slidably on a T-section member on the ridge board. The slot diverges downwardly from the notches 23 as shown.

Figure 4:
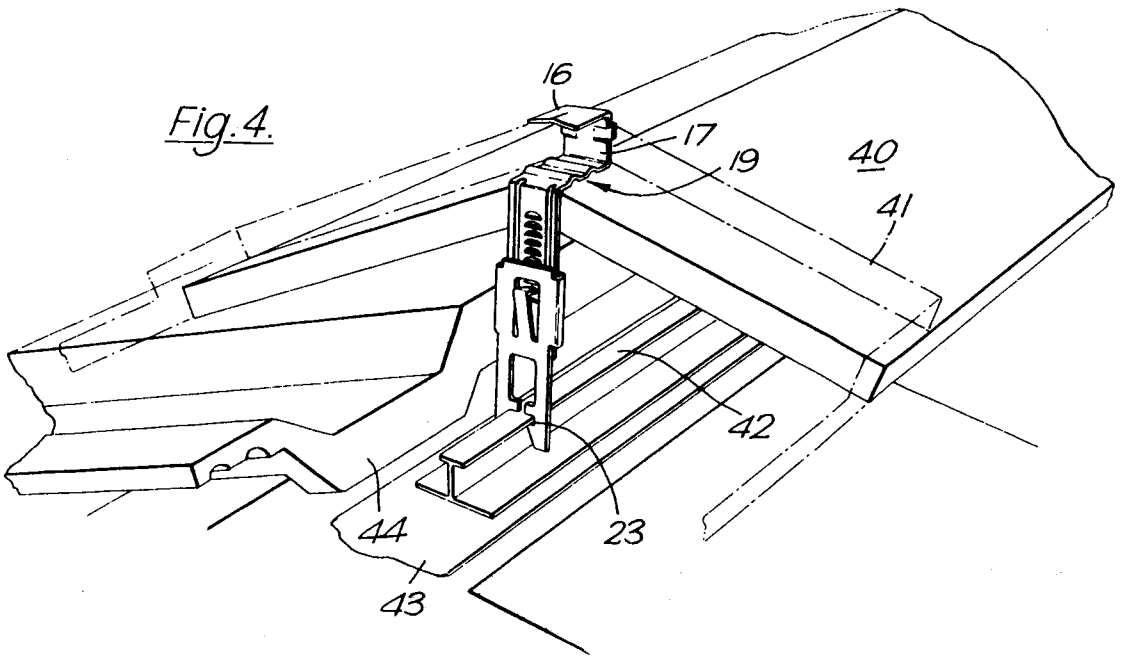
FIG. 4 is a broken-away view of part of a ridge-cap using the clip of FIG. 1.

Referring to FIG. 4, a clip as described is shown securing together two cap-sections 40 and 41 of overlapping type.

Notches 23 engage the top flange of an essentially T-section member 42 attached longitudinally along a ridge-board 43. Flange 19 lies against the upper edge of cap-section 40, the clip length being adjusted by suitable engagement of tongue 22 with a louvre 14 (FIG. 1). Grooves 20 define with the upper suface of cap-section 40 capillary tubes for retention of any water.

The edge of cap-section 41 is then inserted between flanges 16, 19 and butted against web 17, with mortaring if desired.

The clip therefore positively holds down both cap-sections 40 and 41 to ridge-board 43 and therefore the tiles, such as tile 44, over which the capping projects are also held down.

Figure 2:
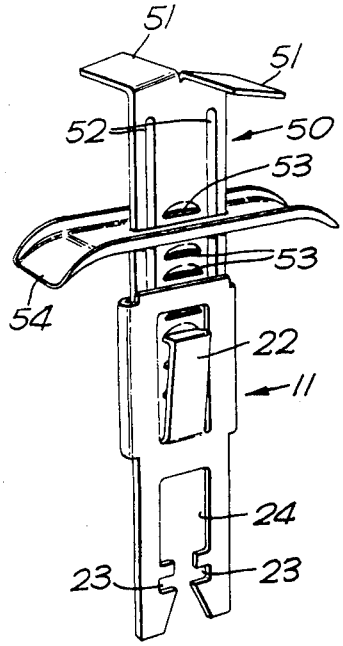
FIG. 2 is a similar view of a clip for butted cap-pieces.

Referring now to FIG. 2, the lower part 11 is exactly similar to that used in FIG. 1 and shown in FIG. 3, The upper part 50 in this case is planar with two oppositely bent lugs 51 at the top, and ribbed edges 52 and louvres 53 equivalent to edges 13 and louvres 14 of FIG. 1.

A washer 54 of plastic material is slidably fitted around part 50 and acts as a water barrier beneath the butted cap-sections.

Figure 5:
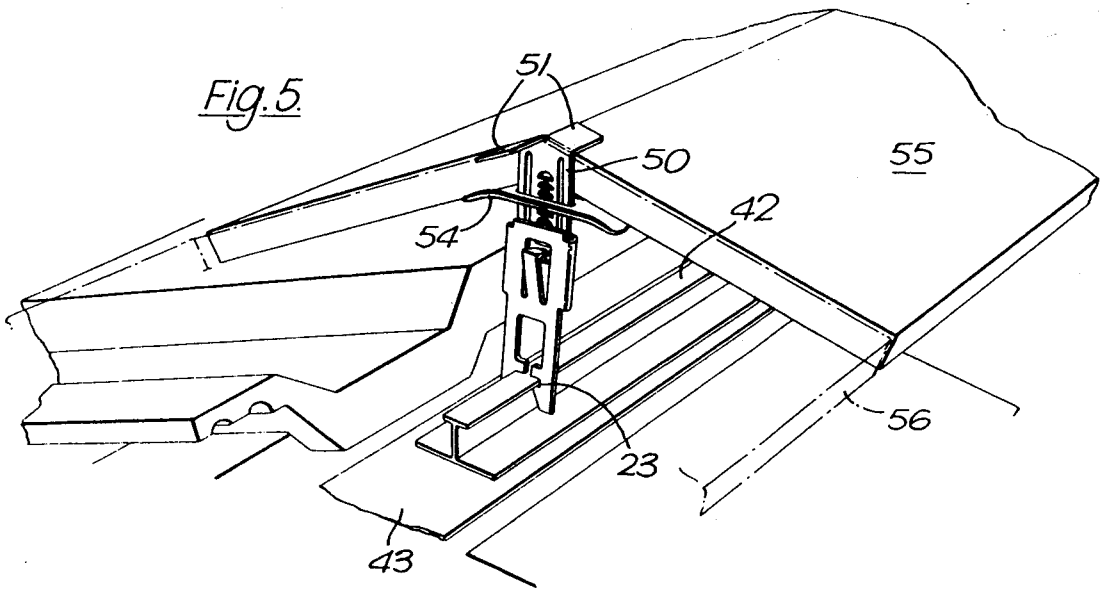
FIG. 5 is a similar view but with butted cap-pieces and the clip of FIG. 2.

FIG. 5 shows a clip of FIG. 2 between the edges of butted cap-sections 55, 56. Attachment to ridge-board 43 is as before by notches 23 and member 42. Lugs 51 pass oppositely over the edges of cap-sections 55, 56, with part 50 lying between these edges. Washer 54 lies directly beneath the joint.

The various parts of the clips other than washer 54 may be made from galvanized or spring steel bent and cut to form the shapes described.

What is claimed is:

1. A clip for securing a ridge- or hip-cap of the type having cap-pieces mounted end-to-end to form a continuous capping, said clip including:

an upright lower part having anchoring means for attaching said part to a T-section member of a building structure, said anchoring means being constituted by a slot in said upright lower part having inwardly projecting lugs to define opposed notches positioned for slidably engaging a flange of the T-section member;

an upper part including a depending section for passing between edges of adjacent cap-pieces and a top section to overlie the top surfaces of both said cap-pieces; and attachment means between said upright lower part and said depending section.

2. A clip as claimed in claim 1, in which said attachment means is adjustable longitudinally of said depending section and of said upright part.

3. A clip as claimed in claim 2, in which said attachment means includes a series of ratchet louvres spaced along said depending section and a projecting tongue on said upright part engaging a selected one of said louvres.

4. A clip as claimed in claim 1 for securing butted cap-pieces, in which said top section includes oppositely-directed lugs on the top of said depending section.

5. A clip as claimed in claim 1 for securing overlap cap-pieces, in which said top section includes a first horizontal flange adapted to lie between the overlapped edges of adjacent cap-section, a vertical web to lie over the exposed edge of the outer cap-section and a second horizontal flange to lie over the outer edge of said outer cap-piece.

6. A clip as claimed in claim 5, in which said first horizontal flange has at least one inverted groove therein transverse to the length of said cap-pieces.

7. A clip as claimed in claim 1 wherein said slot diverges downwardly from said notches.

8. A clip as claimed in claim 1 wherein said lower part has opposite upright edges with rolled portions thereat for slidably receiving lateral edges of said depending sections of said upper part.

9. A clip as claimed in claim 8 in which said attachment means includes a series of ratchet louvres spaced along said depending section and a projecting tongue on said upright part engaging a selected one of said louvres, said tongue being struck from said lower part in a region confined between said rolled portions.

* * * * *